US008636546B2

(12) United States Patent
He et al.

(10) Patent No.: US 8,636,546 B2
(45) Date of Patent: Jan. 28, 2014

(54) CONNECTOR HAVING IMPROVED INSULATIVE HOUSING

(75) Inventors: Jia-Yong He, Kunshan (CN); Zhong-Hua Yao, Kunshan (CN); Qi-Sheng Zheng, Kunshan (CN); Hong-Bin Gong, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 336 days.

(21) Appl. No.: 13/088,431

(22) Filed: Apr. 18, 2011

(65) Prior Publication Data

US 2012/0009811 A1 Jan. 12, 2012

(30) Foreign Application Priority Data

Jul. 8, 2010 (CN) ..... 2010 2 0251869 U

(51) Int. Cl.
*H01R 13/648* (2006.01)

(52) U.S. Cl.
USPC ..... 439/607.4

(58) Field of Classification Search
USPC ..... 439/660, 607.4, 79, 108, 607.35, 439/607.54
See application file for complete search history.

(56) References Cited

U.S. PATENT DOCUMENTS 5,779,489 A * 7/1998 Davis et al. ..... 439/79
6,007,382 A * 12/1999 Wu ..... 439/607.05
6,059,581 A * 5/2000 Wu ..... 439/79
6,270,379 B1 * 8/2001 Huang et al. ..... 439/660
6,347,961 B2 * 2/2002 Zhu et al. ..... 439/607.01
6,659,799 B2 * 12/2003 Yang ..... 439/607.19
6,783,397 B2 * 8/2004 Yang Lee ..... 439/607.45
7,025,632 B2 * 4/2006 Hu et al. ..... 439/606
7,066,769 B2 * 6/2006 Zhu et al. ..... 439/660
7,108,520 B1 * 9/2006 Delaney et al. ..... 439/79
7,128,617 B2 * 10/2006 Wang et al. ..... 439/660
7,422,488 B1 9/2008 Wu
7,445,469 B2 * 11/2008 Wu ..... 439/79
7,479,042 B2 * 1/2009 Chen ..... 439/660
7,517,253 B1 * 4/2009 Chiang ..... 439/660
7,534,141 B1 5/2009 Wu
7,572,146 B1 * 8/2009 Chiang ..... 439/607.01
7,578,700 B2 * 8/2009 Xiong et al. ..... 439/607.01
7,674,118 B2 * 3/2010 He ..... 439/108
7,682,200 B2 * 3/2010 Zheng et al. ..... 439/660
7,686,656 B2 * 3/2010 Zheng et al. ..... 439/660
7,744,426 B2 * 6/2010 Zheng et al. ..... 439/660
7,748,997 B2 * 7/2010 Hamner et al. ..... 439/79
7,806,704 B2 * 10/2010 Miyoshi et al. ..... 439/108

(Continued)

FOREIGN PATENT DOCUMENTS

JP 2011-238507 * 11/2011
TW M359828 6/2009

*Primary Examiner* — Neil Abrams
(74) *Attorney, Agent, or Firm* — Wei Te Chung; Ming Chieh Chang

(57) ABSTRACT

A connector (100) includes an insulative housing (1), a set of contacts (3) attached to the insulative housing, and a metal shell shielding the insulative housing. The insulative housing has a base portion (11) and a tongue portion (12) extending forwardly from the base portion. The base portion has a pair of first bumps (1124) protruding therefrom and located at two sides thereof, and a second bumps (1125) protruding therefrom and located between the first bumps. The metal shell has a pair of first notches (44) locating at two sides thereof and locking with the first bumps, and a second notch (45) located between the first notches and locking with the second bumps.

18 Claims, 7 Drawing Sheets

(56) References Cited

U.S. PATENT DOCUMENTS

| | | | | |
|---|---|---|---|---|
| 7,811,110 | B2 * | 10/2010 | He et al. | 439/218 |
| 7,862,346 | B1 * | 1/2011 | Wan et al. | 439/79 |
| 7,878,847 | B2 * | 2/2011 | He et al. | 439/541.5 |
| 7,883,371 | B1 * | 2/2011 | Chen et al. | 439/607.41 |
| 7,887,373 | B1 * | 2/2011 | Wang | 439/660 |
| 7,909,653 | B1 * | 3/2011 | Wan et al. | 439/660 |
| 7,963,799 | B1 * | 6/2011 | Lee et al. | 439/607.23 |
| 7,972,151 | B2 * | 7/2011 | He et al. | 439/108 |
| 7,988,499 | B2 * | 8/2011 | Lin et al. | 439/701 |
| 8,007,323 | B1 * | 8/2011 | Yao et al. | 439/660 |
| 8,052,431 | B1 * | 11/2011 | He et al. | 439/78 |
| 8,079,854 | B2 * | 12/2011 | He et al. | 439/108 |
| 8,079,879 | B2 * | 12/2011 | Chiang | 439/660 |
| 8,152,566 | B1 * | 4/2012 | Little et al. | 439/607.41 |
| 8,172,585 | B2 * | 5/2012 | Chiu et al. | 439/108 |
| 8,197,281 | B2 * | 6/2012 | Yang | 439/499 |
| 8,215,990 | B2 * | 7/2012 | Ho | 439/607.05 |
| 8,231,410 | B2 * | 7/2012 | Tung et al. | 439/607.01 |
| 8,267,703 | B2 * | 9/2012 | Yao et al. | 439/79 |
| 8,308,513 | B2 * | 11/2012 | Hsu et al. | 439/626 |
| 8,323,057 | B2 * | 12/2012 | Ho | 439/660 |
| 8,388,372 | B2 * | 3/2013 | He et al. | 439/541.5 |
| 2008/0020654 | A1 * | 1/2008 | He et al. | 439/855 |

* cited by examiner

CONNECTOR HAVING IMPROVED INSULATIVE HOUSING

BACKGROUND OF THE INVENTION

1. Field of the Invention

The present invention relates to an USB connector or the like, and more particularly to an USB connector in which an insulative housing is provided with a bump interengaged with a notch defined on a rear portion of a metallic shell.

2. Description of Related Art

At present, Universal Serial BUS (USB) is a widely used as an input/output interface adapted for many electronic devices, such as personal computer and related peripherals. A conventional USB plug connector usually comprises an insulative housing defining a base portion and a tongue portion extending forwardly from the base portion, a plurality of contacts retained in the base portion and extending in the tongue portion for mating with a receptacle connector, and a metal shell shielding the insulative housing and defining an interface with the tongue portion extending therein. Typically, such as disclosed in U.S. Pat. No. 7,422,488 issued on Sep. 9, 2008.

The contacts have contacting portions coupled to the tongue portion, and tail portions retained in a rear portion of the base portion and extending out of the rear portion in some prior arts. The rear portion of the insulative housing which is usually very thin as compared with other and may be readily warped in a height direction, and in case of such deformation the tail portions of the contacts will lose its coplanarity rending unwanted defects.

Hence, an improved connector with an improved housing is desired to overcome the above problems.

BRIEF SUMMARY OF THE INVENTION

According to one aspect of the present invention, a connector comprises: an insulative housing having a base portion and a tongue portion extending forwardly from the base portion, the base portion comprising a pair of first bumps protruding therefrom and located at two sides thereof, and a second bumps protruding therefrom and located between the first bumps; a plurality of contacts attached to the insulative housing; and a metal shell shielding the insulative housing, the metal shell defining a pair of first notches locating at two sides thereof and locking with the first bumps, and a second notch located between the first notches and locking with the second bumps.

According to another aspect of the present invention, a connector comprises: an insulative housing having a base portion defining a second bump protruding upwardly from an upper face thereof and a tongue portion extending forwardly from the base portion, the second bump having at least one securing slot formed thereon; a plurality of contacts attached to the insulative housing; and a metal shell shielding the insulative housing, the metal shell defining a top plate disposed upon the upper face of the base portion, a bottom plate opposite to the top plate, and a pair of side plates connecting the top and bottom plates. The top plate defines at least one securing portion formed thereon for being retained in the securing slots so as to lock with the second bump in a height direction of the insulative housing.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details.

Figure 1:
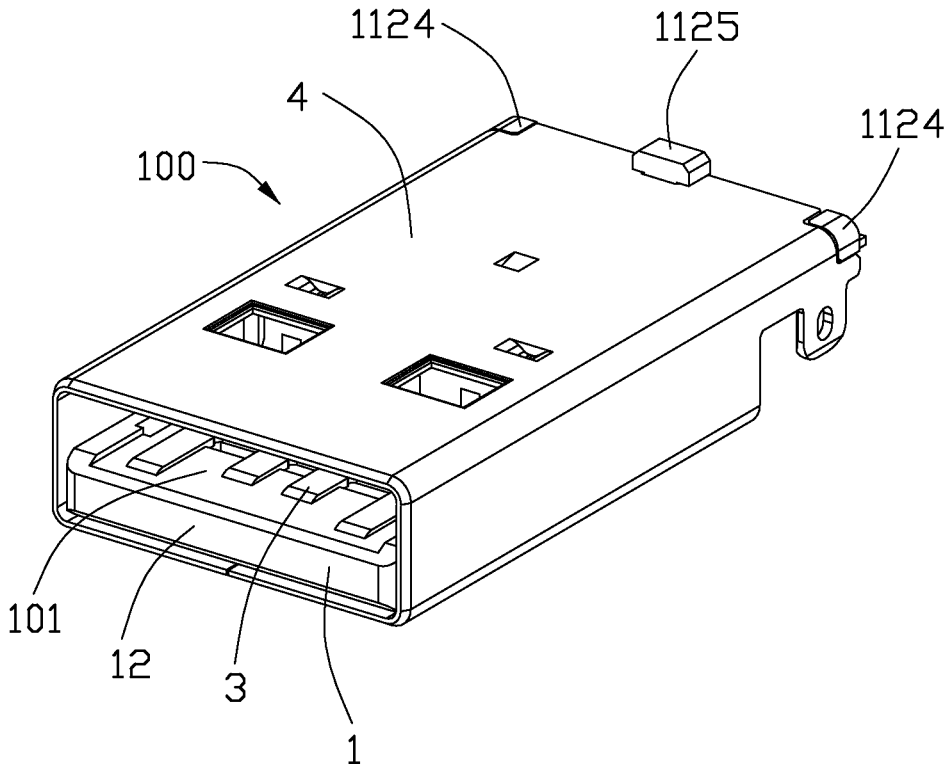
FIG. 1 is an assembled, perspective view of a connector according to an embodiment of the present invention.
Figure 2:
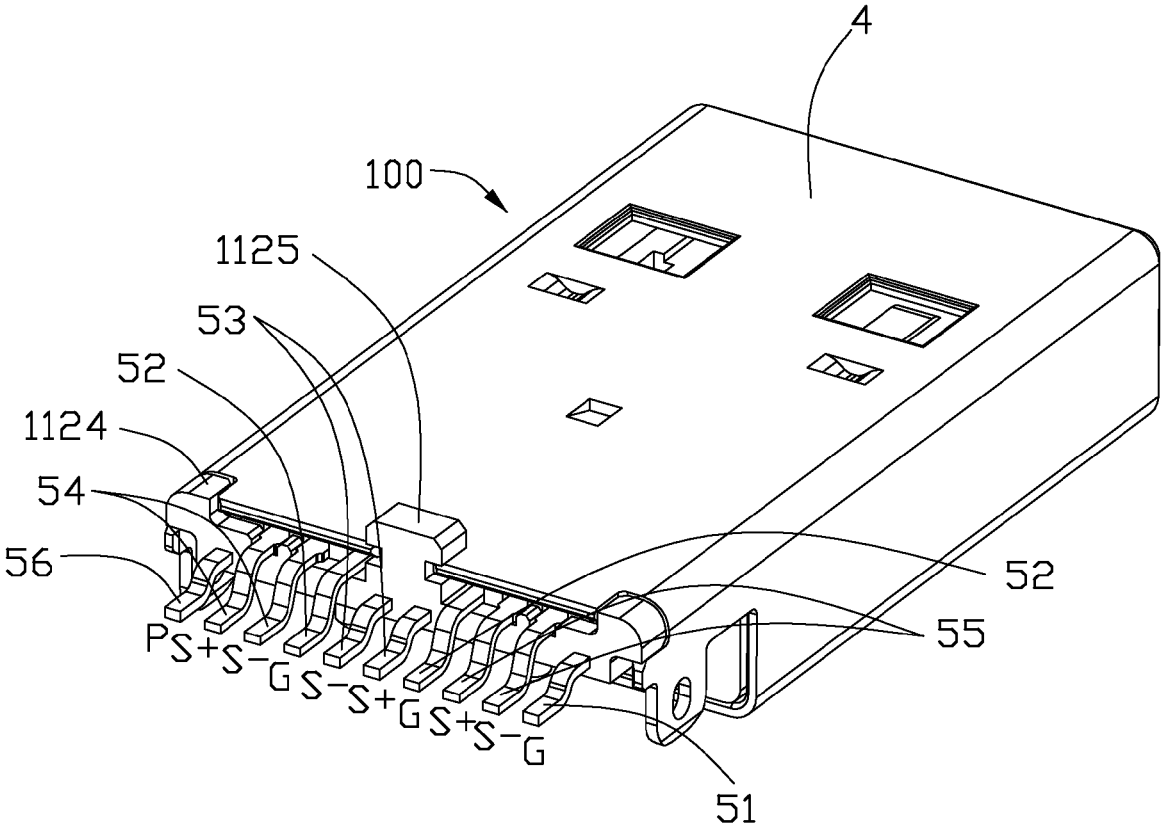
FIG. 2 is similar to FIG. 1, but viewed from another aspect.
Figure 3:
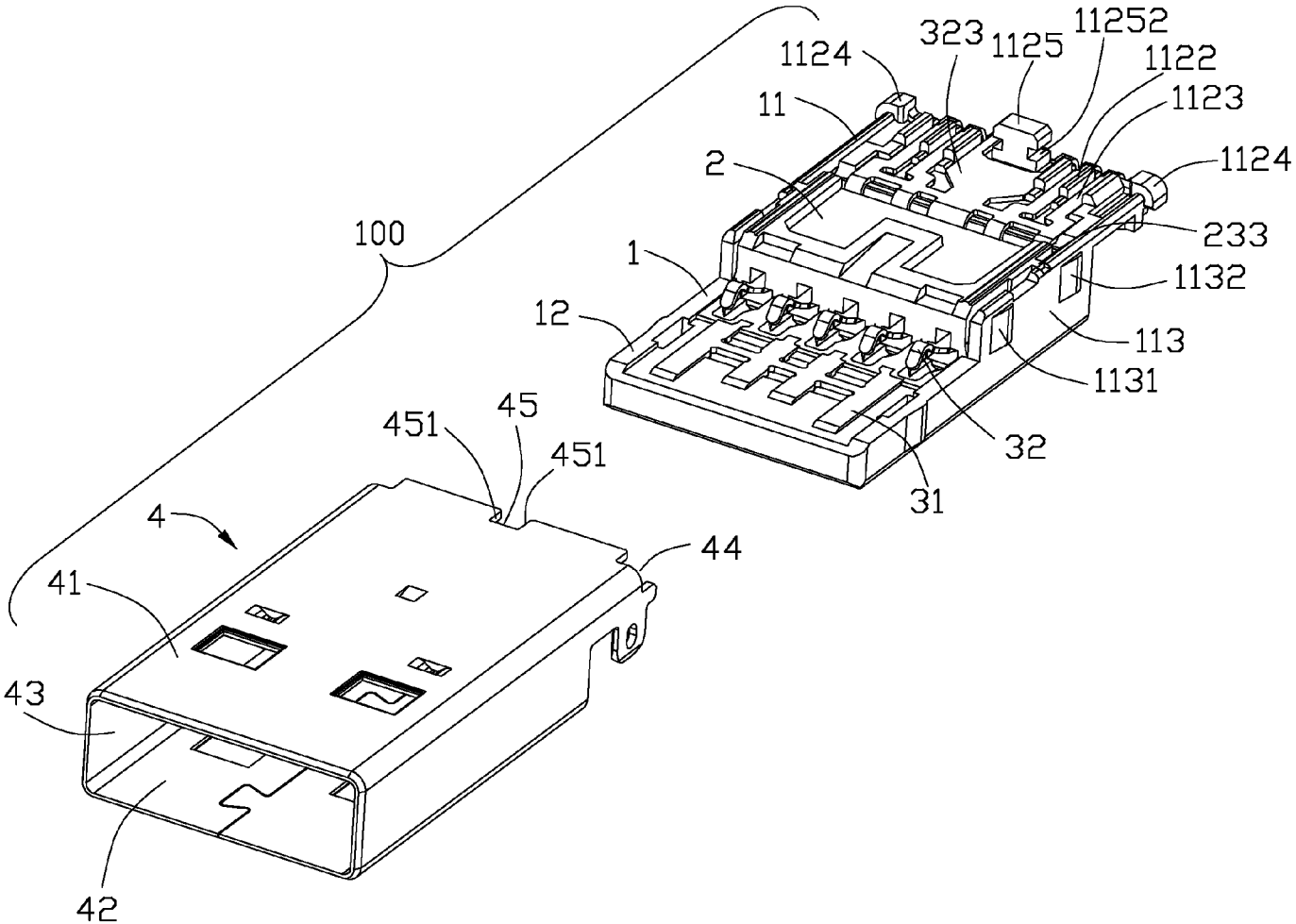
FIG. 3 is a partially exploded view of the connector shown in FIG. 1.
Figure 4:
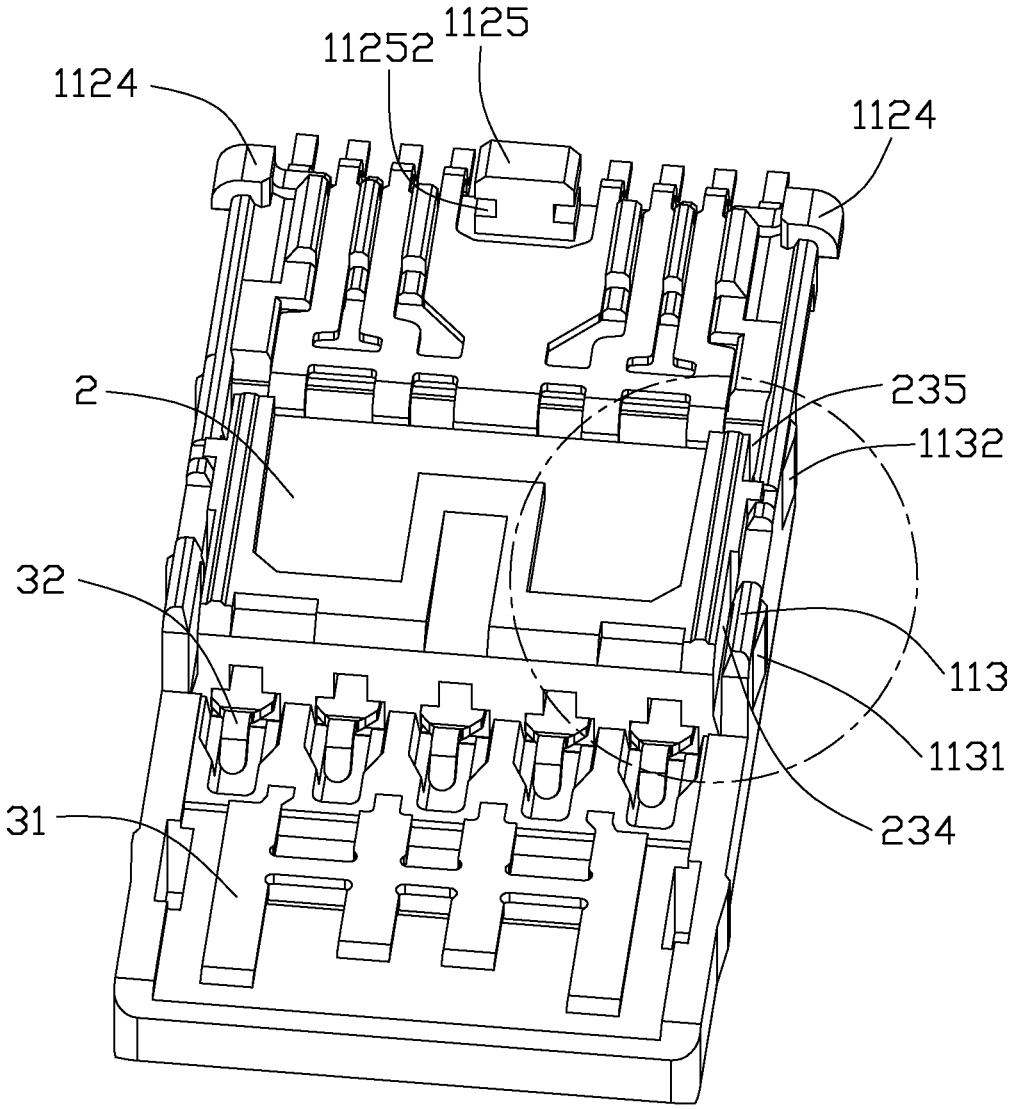
FIG. 4 is a perspective view of the connector with a metal shell removed therefrom.
Figure 5:
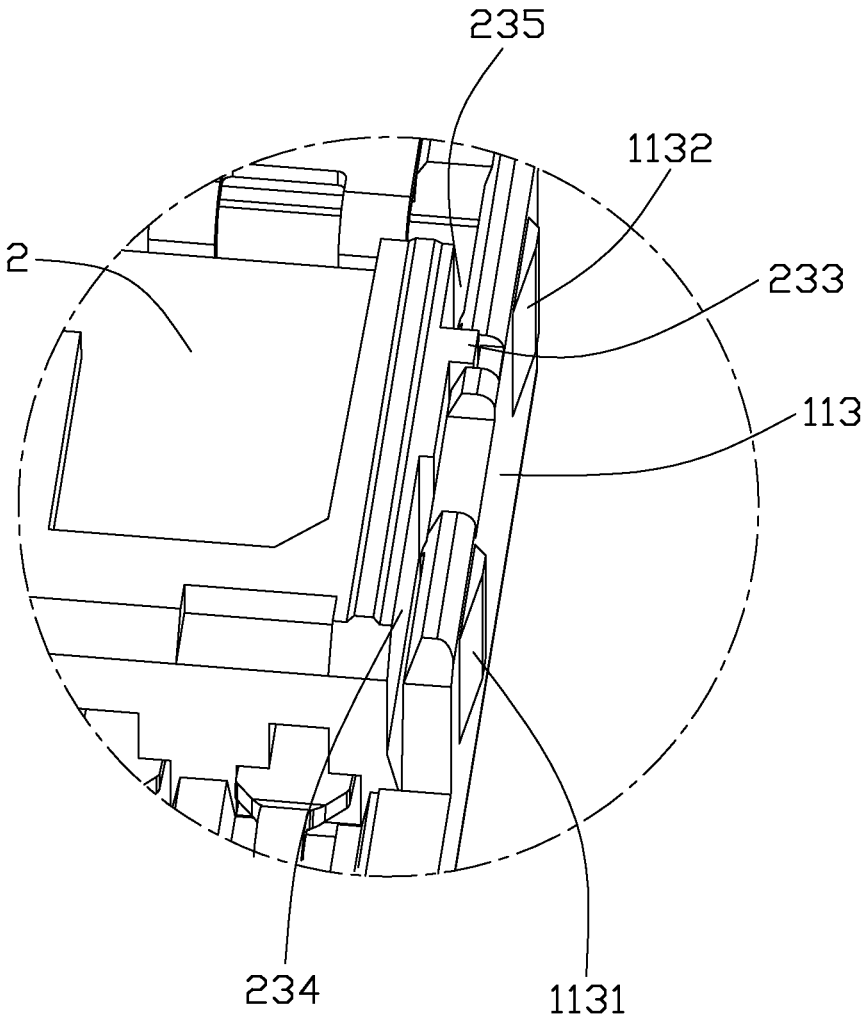
FIG. 5 is an enlarged view of a circle portion in FIG. 4.

Referring to FIGS. 1-3, a connector 100 according to an embodiment of the present invention is an A type USB 3.0 plug connector and defines an interface 101. The connector 100 comprises an insulative housing 1, a set of contacts 3 coupled to the insulative housing 1, an insulator 2 coupled to the insulative housing 1, and a metal shell 4 shielding the insulative housing 1 and the insulator 2.

Referring to FIGS. 3-7, The insulative housing 1 includes a base portion 11 and a tongue portion 12 extending forwardly from a front end of the base portion 11. The base portion 11 has a first portion 111 defining a retaining slot 1110 for receiving the insulator 2 and a pair of side walls 113 located at two lateral sides of the retaining slot 1110, and a second portion 112 extending backwardly from the first portion 111. The first portion 111 and the second portion 112 form as a ladder shape which can be presented explicitly in FIG. 7.

Referring to FIGS. 3-6, each side wall 113 has a first and second protrusions 1131, 1132 protruding outwardly from an outer face thereof, and a recess 1135 depressed from an inner face thereof and communicating with the retaining slot 1110. The recess 1135 locates between the first and second protrusions 1131, 1132 in a front-to-back direction. The first portion 111 has a first opening 1112 passing therethrough in a height direction of the insulative housing 1 and communicating with the retaining slot 1110, a vertical face 1120 facing the retaining slot 1110, and a pair of embossments 1113 protruding into the retaining slot 1110 and located between the first opening 1112 and the vertical face 1120. The second portion 112 has a horizontal upper face 1121 perpendicular to the vertical face 1120, a plurality of ribs 1122 protruding upwardly from the upper face 1121, and a plurality of cavities 1123 exposed to exterior and formed between each two adjacent ribs 1122.

The second portion 112 has a pair of first bumps 1124 protruding upwardly and outwardly therefrom, and a second bump 1125 protruding upwardly from the upper face 1121 and located between the first bumps 1124 in a transverse direction perpendicular to the front-to-back direction. The second bump 1125 is higher than the first bumps 1124 and has a pair of securing slots 11252 formed at two lateral sides thereof for retaining the metal shell 4.

Referring to FIGS. 4-7, the insulator 2 is received in the retaining slot 1110 and has a pair of upheavals 231 protruding outwardly from two side surfaces 23 thereof. The upheavals 231 are received in the corresponding recesses 1135. Each upheaval 231 has a flange 233 protruding outwardly therefrom and being locked into a slit 1130 formed in the recess 1135. Therefore, the insulator 2 could be retained in the insulative housing 1 reliably. When the insulator 2 is assembled to the retaining slot 1110, front and back clearances 234, 235 are defined between the side surface 23 of the insulator 2 and the corresponding inner face of the side wall 113 at front and back of the upheaval 231, the first and second protrusions 1131, 1132 are corresponding to the front and back clearances 234, 235 in the transverse direction. When the metal shell 4 is assembled to the insulative housing 1, the side wall 113 will have an elastic deformation at the front and back clearances 234, 235, therefore, the metal shell 4 could pass over the first and second protrusions 1131, 1132 smoothly so as to prevent the first and second protrusions 1131, 1132 from abrasion. The tongue portion 12 has a number of projections 122 spaced from each other in the transverse direction and forms a number of passageways 123 between each two adjacent projections 122. The insulator 2 is retained between the embossments 1113 and the projections 122 in the front-to-back direction.

Figure 6:
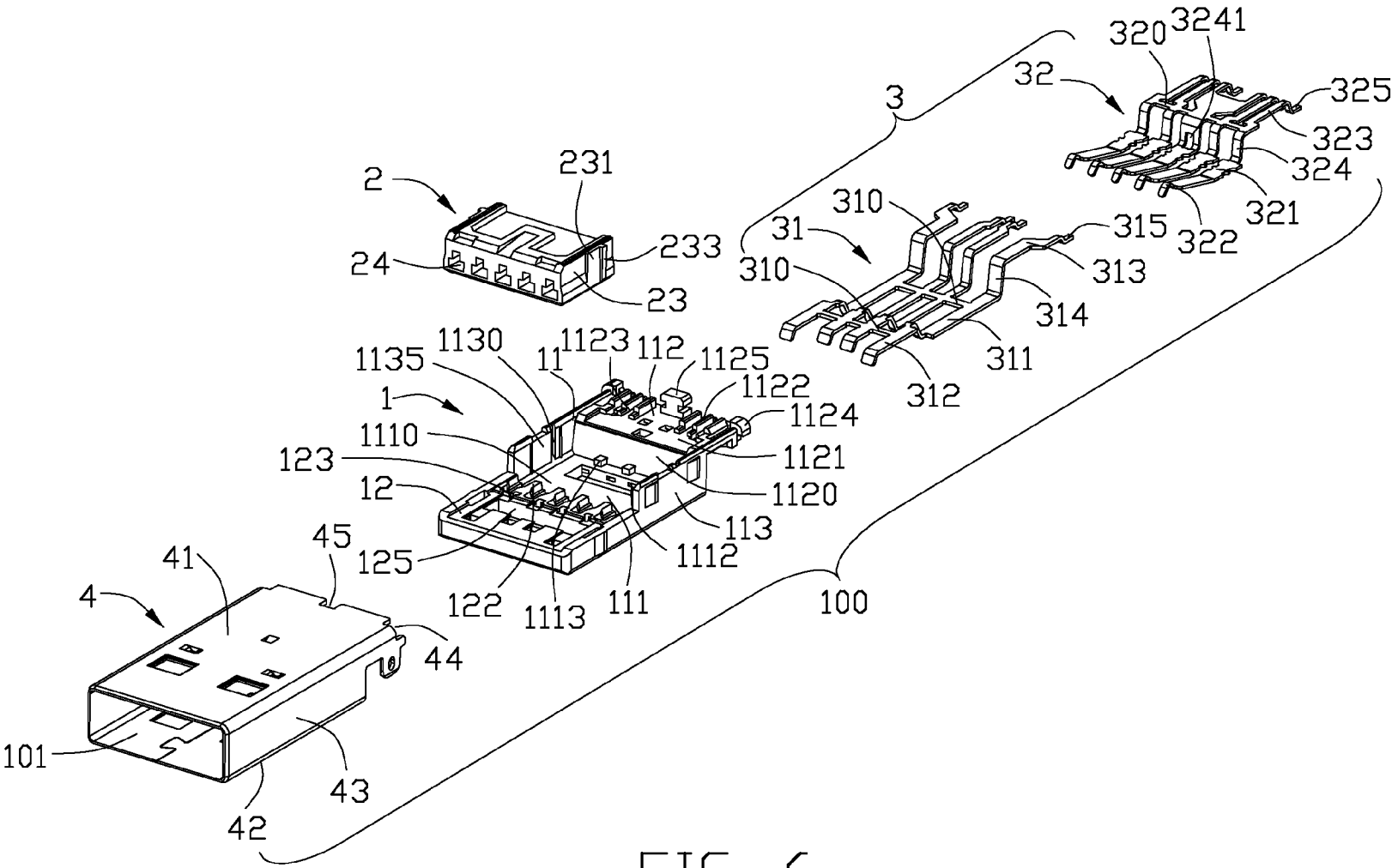
FIG. 6 is an exploded view of the connector shown in FIG. 1.
Figure 7:
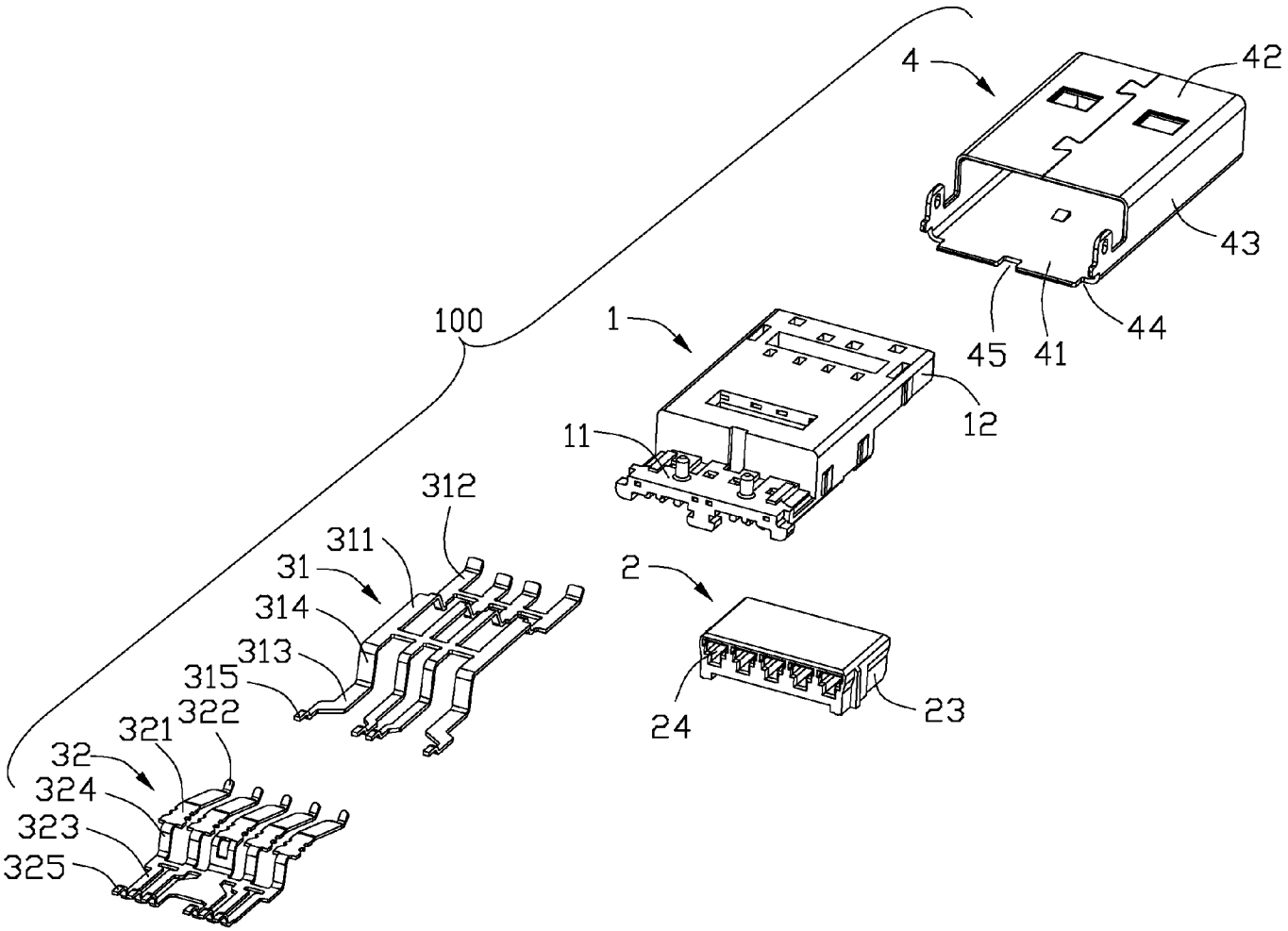
FIG. 7 is similar to FIG. 6, but viewed from another aspect.

Referring to FIGS. 6-7, the contacts 3 are adapted for USB 3.0 protocol, and include a number of first contacts 31 and a number of second contacts 32. The first contacts 31 are adapted for USB 2.0 protocol and connected by two first contact carriers 310 before the first contacts 31 being made out. The first contacts 31 are insert molded into the insulative housing 1. The two first contact carriers 310 will be cut off from the first opening 1112 and a second opening 125 passing through the tongue portion 12 in the height direction so that the first contacts 31 could be separated from each other. The first contacts 31 include stiff first contacting portions 312 retained in the tongue portion 12 and exposed to the interface 101, first connecting portions 311 bending downwardly and extending backwardly from back ends of the first contacting portions 312, first bending portions 314 bending upwardly from back ends of the first connecting portions 311, first offset portions 313 extending backwardly from the first connecting portions 311 and offsetting horizontally, and first tail portions 315 connecting the first offsetting portions 313 and extending backwardly beyond the second portion 112. The two first contact carriers 310 connect the first contacts 31 at the first contacting portions 312 and the first connecting portions 311. The second contacts 32 are connected by a second contact carrier 320 before the second contacts 32 being made out and include resilient second contacting portions 322 received in the passageways 123 of the tongue portion 12, second connecting portions 321 extending backwardly from back ends the second contacting portions 322 and retained in retaining holes 24 passing through the insulator 2 in the front-to-back direction, second bending portions 324 bending upwardly from the second connecting portions 321 and extending through a space formed between the vertical face 1120 and the insulator 2, second offset portions 323 extending backwardly and offsetting horizontally, and second tail portions 325 connecting the second offset portions 323 and extending backwardly beyond the second portion 112. The second offset portions 323 are retained in the cavities 1123 of the second portion 112. The second contact carrier 320 connect the second contact 32 at the second offset portions 323 and is located upon the upper face 1121. In this embodiment, the second contacts 32 are assembled to the insulator 2 so as to form a module retained in the insulative housing 1, In other embodiments, the second contacts 32 could be insert molded into the insulator 2 to form a module retained in the insulative housing 1.

Conjoined with FIG. 7, the first contacts 31 include a first grounding contact 51, a power contact 56, and a first pair of differential contacts 53 located between the first grounding contact 51 and the power contact 56. The first offset portions 313 of the first grounding contact 51 and the power contact 56 offset oppositely along the transverse direction, therefore, a distance measured between the first tail portions 315 of the first grounding contact 51 and the power contact 56 is greater than a distance measured between the corresponding first contacting portions 312 or the corresponding first connecting portions 311. The first offset portions 313 of the first pair of differential contacts 53 offset toward each other in the transverse direction, therefore, a distance measured between the first tail portions 315 of the first pair of differential contacts 53 is smaller than a distance measured between the corresponding first contacting portions 312 or the corresponding first connecting portions 311.

The second contacts 22 include a second pair of differential contacts 54, a third pair of differential contacts 55, and a second grounding contact 52 located between the second and third pairs of differential contacts 54, 55. The second offset portions 323 of the second pair of differential contacts 54 offset toward each other in the transverse direction, therefore, a distance measured between the second tail portions 325 of the second pair of differential contacts 54 is smaller than a distance measured between the corresponding second contacting portions 322 or the corresponding second connecting portions 321. Similarly, the second offset portions 323 of the third pair of differential contacts 55 offset toward each other in the transverse direction, therefore, a distance measured between the second tail portions 325 of the second pair of differential contacts 54 is smaller than a distance measured between the corresponding second contacting portions 322 or the corresponding second connecting portions 321. The second bending portion 324 of the second grounding contact 52 has a width wider than those of the remaining second bending portions 324 and defines a through hole 3241 passing therethrough in the front-to-back direction. The second offset portion 323 of the second grounding contact 52 has a width wider than that of the second bending portion 324 and defines two split said second tail portions 325 spaced from each other in the transverse direction. The second bump 1125 is located between the two second tail portions 325 of the second grounding contact 52.

The first and second tail portions 315, 325 are arranged in one row, all of the second tail portions 325 are arranged between the first tail portions 315 of the first grounding contact 51 and the power contact 56. In another word, relative to the first and second tail portions 315, 325, the first grounding contact 51 and the power contact 56 are arranged at two outermost sides. The second tail portions 325 of the second pair of differential contacts 54 are arranged between the first tail portion 315 of the power contact 56 and one second tail portion 325 of the second grounding contact 52, the second tail portions 325 of the third pair of differential contacts 55 are arranged between the first tail portion 315 of the first grounding contact 51 and the other second tail portion of the second grounding contact 52. Referring to FIG. 3, all of the first and second tail portions 315,325 viewed from a back view and a left-to-right direction are arranged in the following specific sequence: power contact 56 (P) 、the second pair of differential contacts 54 (S+, S−) 、the second grounding contact 53

(G) 、the first pair of differential contacts 52 (S−, S+) 、the second grounding contacts 53 (G) 、the third pair of differential contacts 55 (S+, S−) 、the first grounding contact 51 (G). Therefore, in the first and second tail portions 315,325, each adjacent two pairs of the first, second and third pairs of differential contacts 53, 54, 55 has a grounding contact 52 located therebetween, the space between the first, second and third differential contacts 53, 54, 55 can be increased, the interference between the first, second and third differential contacts 53, 54, 55 can be reduced more effectively.

Referring to FIGS. 1-4, the metal shell 4 surrounds the tongue plate 12 to form the interface 101 and includes a top plate 41, a bottom plate 42 and a pair of side plates 43 connecting the top and bottom plates 41, 42. The metal shell 4 has a pair of first notches 44 formed between the top plate 12 and two side plates 43 and engaging with the corresponding first bumps 1124, a second notch 45 formed in a back side of the top plate 41 and engaging with the second bump 1125. The first bumps 1124 are received in the corresponding first notches 44 and resist the metal shell 4 forwardly, inwardly and downwardly. The second bump 1125 is received in the second notch 45. The top plate 41 has two securing portions 451 on two sides of the second notch 45 retained in the securing slots 11252 so that the top plate 41 could be orientated in the second bump 1125 in the height direction. Therefore, the second portion 112 has two sides resisted upwardly and outwardly by the metal shell 4 via the first bumps 1124 cooperating with the first notches 44, and a midst portion orientated along the height direction by the metal shell 4 via the second bump 1125 cooperating with the second notch 45, the second portion 112 could be presented from warp along the height direction, and the first and second tail portions 315, 325 will be preferably coplanar in a horizontal plane for being soldered to a printed circuit board reliably. In another embodiment, the second bump 1125 could have only one said securing slot 11252 formed thereon, the top plate 41 has one said securing portion 451 extending backwardly from a rear end thereof and being retained in said securing slot 11252. When the metal shell 4 is assembled to the insulative housing 1 along the front-to-back direction, the side wall 113 will have an elastic deformation at the front and back clearances 234, 235, therefore, the side plates 43 of the metal shell 4 could pass over the first and second protrusions 1131, 1132 smoothly, and the first and second protrusions 1131, 1132 could be prevented from abrasion.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A connector comprising:

an insulative housing having a base portion and a tongue portion extending forwardly from the base portion, the base portion comprising a pair of first bumps protruding therefrom and located at two sides thereof, and a second bump protruding therefrom and located between the first bumps;

a plurality of contacts attached to the insulative housing; and a metal shell shielding the insulative housing, the metal shell defining a pair of first notches locating at two sides thereof and engaging with the first bumps, respectively and a second notch located between the first notches and locking with the second bump; wherein the second bump is higher than the first bumps and has a pair of securing slots formed at two lateral sides thereof, the metal shell has a pair of securing portions formed on two sides of the second notch and being retained in the securing slots so that the metal shell locks with the second bump in a height direction of the insulative housing.

2. The connector according to claim 1, wherein the first bumps protrude upwardly and outwardly from the base portion, the metal shell includes a top plate, a bottom plate and a pair of side plates connecting the top and bottom plates, the first notches are formed between the top plate and the side plates under condition that the first notches lock with the first bumps in both a height direction of the insulative housing and a transverse direction perpendicular to the height direction.

3. The connector according to claim 1, further comprising an insulator, the contacts include a plurality of first contacts defining stiff first contacting portions retained in the tongue portion and first tail portions extending out of the insulative housing, a plurality of second contacts retained in the insulator to form a module and having resilient second contacting portions extending upon the tongue portion and located behind the first contacting portions and second tail portions extending out of the insulative housing, the base portion includes a first portion defining a retaining slot for receiving the insulator and a second portion extending backwardly from the first portion under a condition that the second portion is thinner than the first portion in a height direction of the insulative housing, the first and second bumps protruding from an upper face of the second portion.

4. The connector according to claim 3, wherein the second contacts include a second pair of differential contacts, a third pair of differential contacts and a second grounding contact located between the second and third pairs of differential contacts, the second grounding contact defines two split said second tail portions spaced from each other in a transverse direction, the second bump is located between said two second tail portions of the second grounding contact.

5. The connector according to claim 4, wherein the first contacts are insert molded into the insulative housing, the first and second tail portions extend backwardly beyond the second portion and are arranged in one row.

6. The connector according to claim 5, wherein the first contacts include a first grounding contact, a power contact, and a first pair of differential contacts located between the first grounding contact and power contact, the first tail portions of the first pair of differential contacts are located between said second tail portions of the second grounding contact, the first tail portions of the first grounding contact and the power contact are located at outermost of said one row.

7. A connector comprising:

an insulative housing having a base portion defining a second bump protruding upwardly from an upper face thereof and a tongue portion extending forwardly from the base portion, the second bump defining a pair of said securing slots formed at two lateral sides thereof and extending horizontally;

a plurality of contacts attached to the insulative housing; and a metal shell shielding the insulative housing, the metal shell defining a top plate disposed upon the upper face of the base portion, a bottom plate opposite to the top plate, and a pair of side plates connecting the top and bottom plates, the top plate defining a second notch and a pair of securing portions formed on two sides of the second notch to be retained in said securing slots respectively so as to lock with the second bump upwardly and downwardly.

8. The connector according to claim 7, wherein the contacts include a plurality of first contacts defining stiff first contacting portions retained in the tongue portion and first tail portions extending out of the base portion, a plurality of second contacts defining resilient second contacting portions extending upon the tongue portion under a condition that the second contacting portions are located behind the first contacting portions and second tail portions extending out of the base portion.

9. The connector according to claim 8, wherein the second contacts include a second pair of differential contacts, a third pair of differential contacts and a second grounding contact located between the second and third pairs of differential contacts, the second grounding contact defines two split said second tail portions spaced from each other in a transverse direction, the second bump is located between said two second tail portions of the second grounding contact.

10. The connector according to claim 9, wherein the first and second tail portions are arranged in one row, the first contacts include a first grounding contact, a power contact, and a first pair of differential contacts located between the first grounding contact and power contact, the first tail portions of the first pair of differential contacts are located between said second tail portions of the second grounding contact, the first tail portions of the first grounding contact and the power contact are located at outermost of said one row.

11. The connector according to claim 10, wherein the base portion defines a pair of first bumps protruding upwardly and outwardly from the upper face and located at two sides of the second bump, the metal shell has a pair of first notches formed between the top plate and the side plates for resisting the first bumps backwardly, upwardly and outwardly.

12. The connector according to claim 11, wherein the first bumps are located at two sides of the first and second tail portions and are lower than the second bump along a height direction of the insulative housing.

13. An electrical connector comprising:

an insulative housing defining a mating face in a vertical direction and a bump extending in the vertical direction;

a plurality of first contacts embedded within the housing, each of the first contacts defining a front contacting section of the first contact exposed upon the mating face, and a rear tail section of the first contact and a medium section of the first contacts therebetwen in a front-to-back direction perpendicular to said vertical direction;

a plurality of second contacts assembled to an insulator which is assembled to the housing, each of said second contacts defining a front contacting section of the second contact exposed upon the mating face and a rear tail section of the second contact and a medium section therebetween in the front-to-back direction, the contacting sections of the first contacts and the contacting sections of the second contacts being essentially alternately arranged with each other in a transverse direction perpendicular to said vertical direction and said front-to-back direction, and the contacting sections of the second contacts being located behind the contacting sections of the first contacts in said front-to-back direction;

the medium section of the first contacts and the medium section of the second contacts being essentially located at different levels in the vertical direction; and the tail sections of the first contacts and the tail sections of the second contacts arranged in a same row in the transverse direction under condition that there are totally ten of said tail sections of the first contacts and said tail sections of the second contacts in a sequence in said row are categorized with a power contact, a first differential pair, a first ground contact, a second differential pair, a second ground contact, a third differential pair, and a third ground contact; wherein there are totally nine of said first contacts and said second contacts under condition that the first ground contact and the second ground contact are essentially of a same one of either said first contacts or said second contacts sharing the same single contacting section.

14. The electrical connector as claimed in claim 13, wherein the first ground contact and the second ground contact are of the same second contact.

15. The electrical connector as claimed in claim 14, wherein the contact sections of said first contacts are not deflectable while the contacting sections of said second contacts are deflectable.

16. The electrical connector as claimed in claim 15, wherein there are totally four of said first contacts while there are totally five of said second contacts.

17. The electrical connector as claimed in claim 13, wherein the second contacts extend through the insulator.

18. The electrical connector as claimed in claim 13, where all of the tail sections of the first contacts are symmetrically arranged with regard to a centerline of the housing, and all of the tail sections of the second contacts are symmetrically arranged with regard to the centerline.

* * * * *